US008534576B2

(12) United States Patent
Grohe et al.

(10) Patent No.: US 8,534,576 B2
(45) Date of Patent: Sep. 17, 2013

(54) SHOWER HEAD FOR A SANITARY SHOWER FITTING

(75) Inventors: Klaus Grohe, Schiltach (DE); Hubert Moosmann, Schiltach (DE); Ulrich Kinle, Schenkenzell (DE); Markus Woehrle, Schiltach (DE)

(73) Assignee: Hansgrohe SE, Schiltach (DE)

( * ) Notice: Subject to any disclaimer, the term of this patent is extended or adjusted under 35 U.S.C. 154(b) by 294 days.

(21) Appl. No.: 12/886,093

(22) Filed: Sep. 20, 2010

(65) Prior Publication Data

US 2011/0108640 A1 May 12, 2011

(30) Foreign Application Priority Data

Sep. 23, 2009 (DE) ..... 10 2009 047 907

(51) Int. Cl.
*B05B 1/34* (2006.01)

(52) U.S. Cl.
USPC ..... 239/463; 239/423

(58) Field of Classification Search
USPC ..... 239/461, 463, 489, 504, 533.14, 239/589, 590.3, 592, 594, 596, 423
See application file for complete search history.

(56) References Cited

U.S. PATENT DOCUMENTS

| | | | | |
|---|---|---|---|---|
| 1,493,150 | A | 5/1924 | Deming | |
| 2,285,831 | A * | 6/1942 | Pennypacker | 239/460 |
| 2,510,395 | A * | 6/1950 | Goodrie | 239/428.5 |
| 2,761,662 | A * | 9/1956 | Goodrie | 239/428.5 |
| 4,796,815 | A | 1/1989 | Greenberg et al. | |
| 6,276,614 | B1 * | 8/2001 | Huang | 239/383 |
| 6,659,372 | B2 * | 12/2003 | Marsh et al. | 239/560 |
| 7,328,858 | B2 * | 2/2008 | Bosio | 239/444 |

FOREIGN PATENT DOCUMENTS

| | | | |
|---|---|---|---|
| DE | 909919 | A | 4/1954 |
| DE | 3018917 | A1 | 11/1981 |
| DE | 3300469 | A1 | 7/1984 |
| DE | 3828111 | A1 | 2/1990 |
| DE | 29710111 | U1 | 11/1998 |
| DE | 102008019930 | A1 | 10/2008 |
| GB | 387400 | A | 2/1933 |
| GB | 2202764 | A | 10/1988 |
| WO | 9523029 | A1 | 8/1995 |

OTHER PUBLICATIONS

DE official action dated Sep. 30, 2010 in No. 10 2009 047 907.4-51.

* cited by examiner

*Primary Examiner* — Davis Hwu
(74) *Attorney, Agent, or Firm* — Duane Morris LLP

(57) ABSTRACT

A shower head for a hand-held shower attachment, an overhead shower attachment or a side shower attachment contains, in its shower-head housing, a vortex chamber which is of funnel shape with the side wall curved. The funnel begins, at the location of the largest diameter, in a radial plane and then decreases in diameter along a curved contour to an exit, where the walls of the funnel run in the axial direction. At the location of the largest diameter of the vortex chamber, upstream of this tapering region, the water is let in tangentially in the circumferential direction and in the axial direction. The vortex which is generated by virtue of the water being let in tangentially accelerates its speed of rotation in the direction of the spray disc. Arranged at the end of the tapering region is a jet-outlet chamber which is very flat, but is of large diameter in relation to the vortex chamber. The vortex travels into this jet-outlet chamber, and therefore, even in the outer region, water jets exit with a massage action out of the jet-outlet openings which are present there.

24 Claims, 6 Drawing Sheets

SHOWER HEAD FOR A SANITARY SHOWER FITTING

The invention relates to a shower head for a sanitary shower fitting.

There are a large number of sanitary shower fittings—be these hand-held shower attachments, overhead shower attachments or side shower attachments—with which it is possible to achieve a massage action. For this purpose, use is made of mechanically moving elements which can lead to the individual water jets being interrupted. Oscillators, which change the direction of the exiting water jets, are likewise known. A further option for producing a kind of massage action may be provided by aerated water jets.

In a further known massage shower attachment (DE 3018917), a partially rotating water flow is generated in a cylindrical chamber within the shower head. For this purpose, some of the water flowing into the shower attachment is directed axially into the chamber, while the rest of the water is introduced at a number of locations obliquely in relation to the axis of the cylindrical chamber. The one end of the chamber is provided with the spray disc.

In the case of a further known hand-held shower attachment (DE 3300469), the shower head contains a hemispherical vortex chamber in which a water vortex is generated about an axis which runs parallel to the spray disc. Pulsating jets exit out of a small number of holes in the planar boundary surface of this chamber. The massage action can be enhanced by mechanical devices.

In the case of yet a further shower attachment (DE 29710111), this one generating individual droplets, the water is introduced tangentially, in a shower-attachment housing, at the location with the smallest diameter. The shower-attachment housing then widens in the shape of a funnel, and the jet-outlet openings are arranged at the end with the largest diameter.

It is an object of the invention to provide a shower head for a sanitary shower fitting which, without moving parts, can generate shower jets with a massage action with special effects.

In order to achieve this object, the invention proposes a shower head having the features cited in Claim 1. Developments of the invention form the subject matter of dependent claims.

The water thus passes tangentially into the chamber arranged in the shower-head housing, to be precise at a location where the chamber has its largest diameter. The water flow forms a vortex which, on account of the tapering cross section of the chamber, is then accelerated further. When the shower attachment starts up, a pocket of air forms in the interior of the incipient vortex, and this pocket of air circulates with the vortex, although it moves around eccentrically rather than being arranged constantly in the centre. As a result, water jets with a periodically changing voltage exit at the outlet of the jet openings of the spray disc. This gives rise to a massage effect without mechanically moving parts having to be used. In addition, there is no need for the water jet which enters into the shower attachment to be split. The function is maintained even when the pocket of air disappears following a relatively long period of operation.

The chamber which is formed in the shower-head housing, and could also be referred to as a vortex chamber, has, in a cross section parallel to the spray disc, a rounded circumference, in order to assist the vortex which is generated by the tangentially entering water. It has been found, surprisingly, that the circumference or the cross section through the vortex chamber need not be round. It is also the case that an oval shape, which results in the jet-outlet disc being elongate, can be provided with a massage action in this way. There are therefore relatively wide-ranging possibilities available for the shaping of a shower attachment.

In a further development of the invention, it may be provided that the water guide for the water entering into the chamber also opens out tangentially in the inlet region of the chamber as seen in the axial direction. The axial direction is to be understood as the direction which is perpendicular to the jet-outlet disc.

In a development, the tapering region, which adjoins the inlet region of the chamber, preferably begins such that its wall begins virtually parallel to a cross-sectional plane. In other words, there is a pronounced reduction in the cross section of the chamber at the beginning of the tapering region. As the tapering region progresses, the wall of this region then approaches, along a curved transition, a direction which is perpendicular to the spray disc, and therefore the end of the tapering region has a wall which runs tangentially to the axial direction.

The transition between the beginning and the end of the tapering region thus runs along a contour of more or less pronounced curvature, and therefore the vortex which is generated in the chamber is not disturbed in any way along this smooth transition.

In a development of the invention, the tapering region may be configured such that, as it progresses, the diameter of the chamber decreases considerably, for example in a ratio of approximately 2:1 to approximately 6:1.

In contrast, the axial extent of the tapering region, that is to say the dimensions perpendicular to the cross section running parallel to the spray disc, may be considerably smaller than the maximum diameter of the chamber. The axial extent may be, for example, in a region of 1:2 to approximately 1:5 in relation to the maximum diameter of the vortex chamber.

Since the shower head proposed by the invention need not necessarily differ, in respect of its outer configuration, from conventional shapes, it may be provided, in a development of the invention, that the water inlet into the housing is arranged radially. If the shower head is a hand-held shower attachment, it is thus possible for the grip of the hand-held shower attachment to be arranged radially in relation to the shower head.

If, in contrast, the shower head is an overhead shower attachment or a side shower attachment, it may also be provided according to the invention that the water inlet into the housing runs in the axial direction, that is to say perpendicularly to the spray disc. In the case of an axially running water inlet into the housing, it may be provided that this inlet, rather than being arranged in the centre of the shower head, is offset laterally.

In order to generate a tangential flow in the vortex chamber, despite the axial and/or radial progression of the water inlet into the housing, it may be provided, in a development of the invention, that the water guide from the water inlet to the chamber is designed as a channel which runs outside the chamber, along the circumference of the chamber, at least to the extent where it passes at least more or less tangentially into the chamber, for example over an arc length of 20°, preferably over an arc length of at least approximately 45°.

This channel then opens out in the chamber as an outlet opening.

The outlet opening preferably likewise runs along the circumference, to be precise here too, once again, along an arc length which is sufficient to ensure entrance into the chamber in a vortex-generating direction. This may be, for example, at least approximately 15°.

In a further development of the invention, it may be provided that the outlet opening of the channel is located in a plane which runs parallel to the spray disc.

It may be provided, in a development of the invention, that the outlet opening of the channel is located opposite the wall located more or less in a radial plane at the beginning of the tapering region. The entering water is thus directed right into the tapering region.

According to the invention, it may be provided that the channel of the water guide itself has a gradually decreasing cross section. This gives rise to a uniform and defined entry jet into the vortex chamber.

It is also possible for throughflow-regulating means to be provided upstream of the channel. This influences the flow speed and, as a result, the massage frequency.

Since the tapering region has a decreasing cross section, it terminates at a location with the smallest cross section, that is to say a constriction. According to the invention, then, it may be provided that this location is adjoined by a jet-outlet chamber bounded by the spray disc. There is thus a certain distance present between the end of the tapering region, that is to say the constriction, and the spray disc. This distance forms the thickness of the jet-outlet chamber.

Depending on the requirements of each individual case, the diameter of the jet-outlet chamber may be identical to the diameter of the constriction.

However, it is likewise possible, and preferred by the invention, for the diameter of the jet-outlet chamber to be greater, in particular considerably greater, than the minimum diameter of the tapering region. In particular, it may be provided that the diameter of the jet-outlet chamber is approximately equal to, or even somewhat greater than, the maximum diameter of the vortex chamber in its inlet region.

It has been found, surprisingly, that such an increase in the diameter of the jet-outlet chamber in relation to the end of the tapering region nevertheless results in a massage action even at the outer regions of the jet-outlet disc, this massage action being a particularly pleasant one.

According to the invention, it may be provided that, on its side which is directed away from the spray disc, the jet-outlet chamber is terminated by a base around the end of the tapering region. This base may be, in particular, planar.

The jet-outlet chamber, which is formed between the jet-outlet disc and the base, is preferably designed as a flat chamber, the thickness of which is considerably smaller than the diameter of the exit opening of the tapering region.

Water passes into the vortex chamber at the location where the vortex chamber has its largest diameter. According to the invention, then, it may be provided that, on that side of the inlet region which is directed away from the spray disc, the chamber formed in the shower head continues as far as a rear wall of the shower-head housing.

It may be provided, in a development of the invention, that the spray disc has a plurality of regions which can be supplied with water separately from one another with the aid of a changeover device. The regions may preferably have jet-outlet openings of different sizes in order, in this way, to generate differently acting massage jets. For example, harder massage jets may be generated in the centre, whereas the periphery of the spray disc can benefit from the particular advantage of the shower attachment according to the invention for generating soft massage jets.

Further features, details and advantages of the invention can be gathered from the claims and from the abstract, the wording of both of which is incorporated into the content of the description by reference, from the following description of preferred embodiments of the invention and with reference to the drawing, in which:

Figure 1:
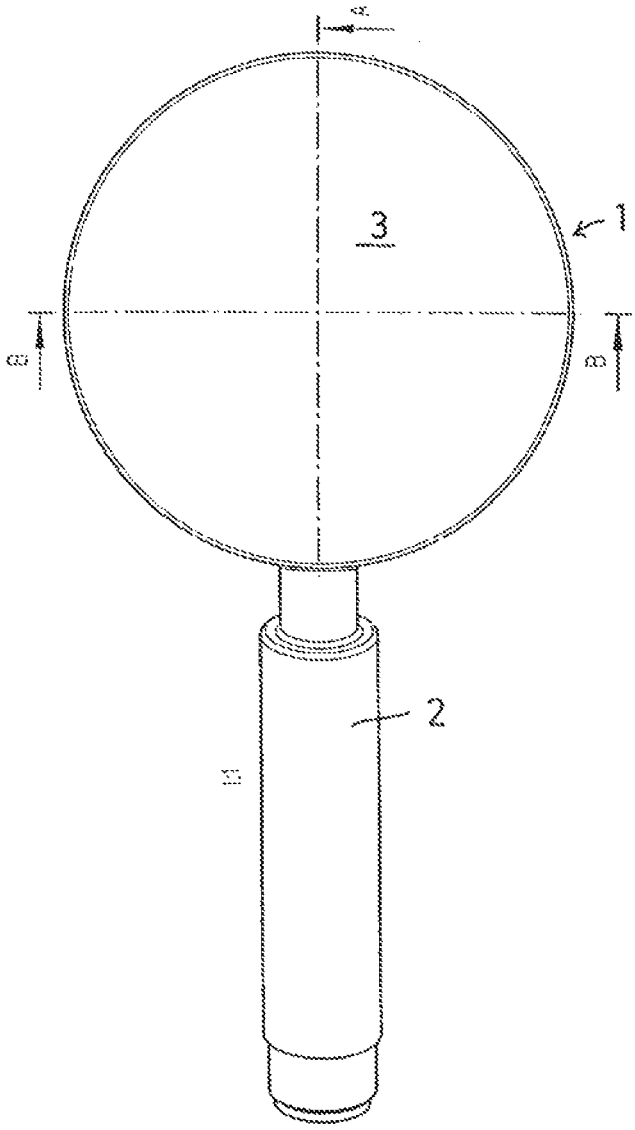
FIG. 1 shows a view of a hand-held shower attachment.

Referring first of all to FIG. 1, the latter illustrates a hand-held shower attachment from the rear side thereof. The hand-held shower attachment has a shower head 1 of circular outline with a grip 2, the grip 2 being angled slightly out of the plane of the shower head 1, but running radially in relation to the housing of the shower head. A connection for a shower-attachment hose is present at the free end of the grip.

Figure 2:
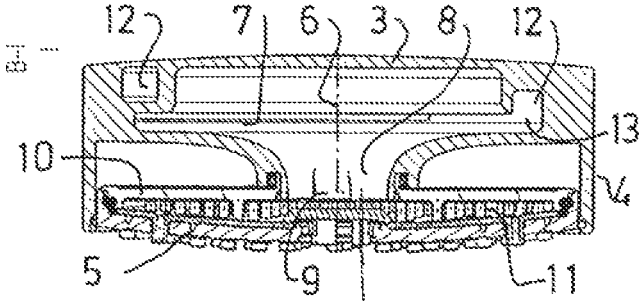
FIG. 2 shows a cross section through the shower head of the hand-held shower attachment of FIG. 1.

FIG. 2 shows a cross section through this shower head, as seen along a diameter. The shower head or the housing thereof has a rear wall 3 and an outer wall 4. On the side which is directed away from the rear wall 3, the shower head contains a spray disc 5, which has a multiplicity of jet openings through which the shower water exits in individual jets. Formed within the housing of the shower head is a chamber 6 which has a first region, which is directly adjacent to the rear wall 3 and which is then adjoined by a narrow, but enlarged-diameter inlet region 7. Starting from the inlet region 7, where the diameter is greatest, the walls of the chamber 6 yield inwards in the direction of the spray disc 5 and thus form a tapering region 8, which may also be referred to as a funnel with curved side walls. This tapering region 8 opens out in a constriction 9, which is arranged opposite the spray disc 5. A base 10 is arranged in the housing of the shower head in the region outside that end of the tapering region 8 which is assigned to the spray disc 5. This results in the formation, between the base 10 and the spray disc 5, of a jet-outlet chamber 11 which has a very small thickness, but has a diameter which is larger than the largest diameter of the chamber 6, that is to say within the inlet region 7.

The housing of the shower head has formed in it, outside the upper region of the chamber 6, a channel 12, which extends along a circumference around the chamber 6. The channel 12 has a rectangular cross section with rounded edges. On the right-hand side in FIG. 2, the channel 12 has an outlet opening 13 on its underside, that is to say the side which is directed towards the spray disc 5. The water passes out of the channel 12, into the chamber 6, through this outlet opening 13. The channel 12 is connected to the interior of the handgrip 2 at its end which is opposite to the outlet opening 13, this not being illustrated in FIGS. 1 and 2.

Figure 3:
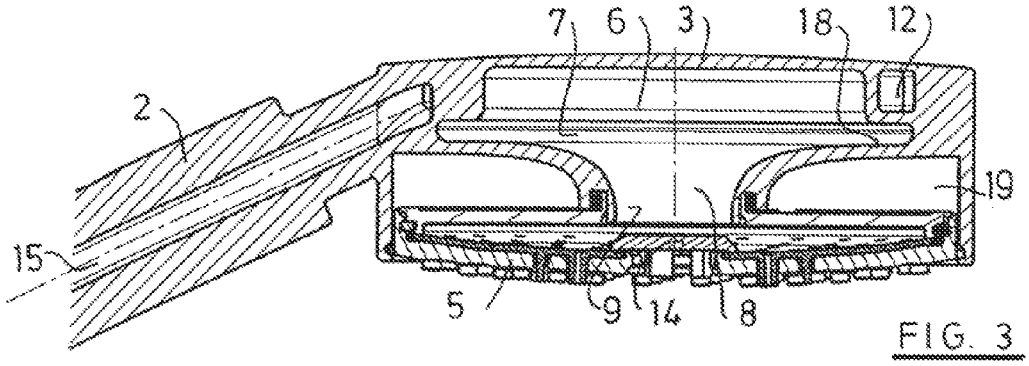
FIG. 3 shows a longitudinal section through a hand-held shower attachment.

FIG. 3 shows, on an enlarged scale, a longitudinal section through the shower head in a plane rotated through 90°. The tapering region 8 begins at the end of the inlet region 7 in a form in which the wall of the chamber 6, in the first instance, is guided inwards virtually in a radial plane. In other words, the radial plane runs tangentially to the wall of the chamber 6 in the tapering region 8. The wall of the chamber 6 in the tapering region 8 leads far inwards and then merges, over a curved arc, into the constriction 9, where the tapering region 8 terminates in an opening with its periphery running in a plane parallel to the spray disc 5. At this location, the wall of the tapering region runs in the axial direction, that is to say perpendicularly to the plane of the spray disc 5. Arranged on the inside of the spray disc 5, in the example illustrated, is a plate 14 which, on its outer periphery, has an oblique surface by means of which the water passing through the constriction 9 is redirected radially outwards.

The handgrip 2 contains a channel 15 through which the water flows into the shower head through the shower-attachment hose. This channel 15 is connected to the aforementioned channel 12 via an arcuate conduit portion 16. The channel 12 runs, see also FIG. 4, around the chamber 6 over an arc of approximately 270°. The outlet opening 13 is formed at the end of the channel 12 and, since the channel 12 moves gradually downwards there, the outlet opening likewise has a relatively long arc length, in this case in the region of 45°. The water leaving the channel 12 through the outlet opening 13 thus passes tangentially into the chamber 6.

Figure 5:
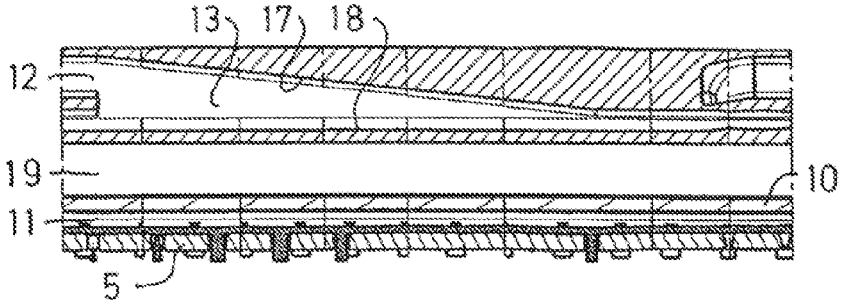
FIG. 5 shows a curved partial section through the shower head of FIG. 3.

The partial section in FIG. 5 shows the end of the channel 12. That boundary wall of the channel 12 which is located in the direction of the rear wall 3 of the housing of the shower head runs continuously downwards here in the direction of the spray disc and forms a slope 17 there. The very long outlet opening 13 is formed in this way. The water which flows out here thus also passes tangentially into the chamber 6, which is formed in the housing, in the axial direction, that is to say from top to bottom in FIG. 5.

It is evident from both FIG. 2 and FIG. 5 that the location of the outlet opening 13 of the channel 12 is the location of the boundary wall of the chamber 6 in the tapering region 8 of the latter. The water which exits from the outlet opening 13 thus flows onto this beginning 18 of the tapering region 8. The water is directed further in a circular movement around the axis of the shower-head housing without being disturbed by protrusions, inflections or the like.

As soon as the water has passed the constriction 9, the circulating flow causes it to pass into the flat jet-outlet chamber 11, from where it leaves the shower head through the jet-outlet openings which are present there. The circulating flow gives rise to greater or lesser volumes in a pattern which rotates in circular form around the axis of the chamber 6.

An interspace 19 which is air-filled, but does not perform any function, is formed between the outside of the chamber 6, in the tapering region 8 of the latter, and the base 10, which is provided at the end of the tapering region. This interspace 19 can also be seen in the section in FIG. 5.

Figure 6:
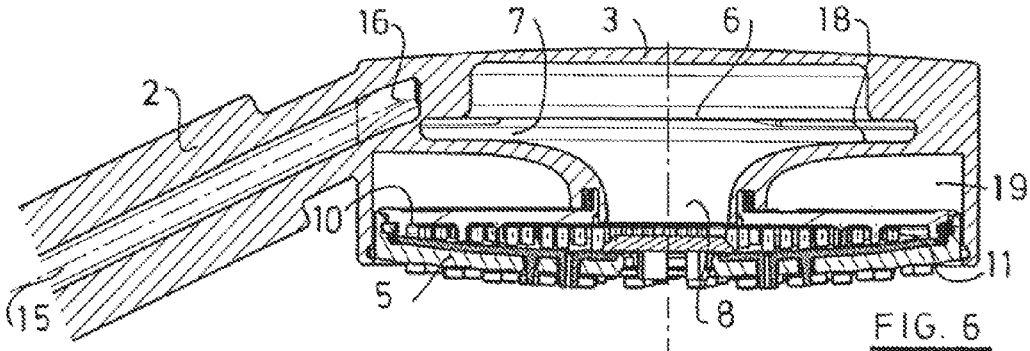
FIG. 6 shows a section corresponding to FIG. 3, but relating to another embodiment.
Figure 7:
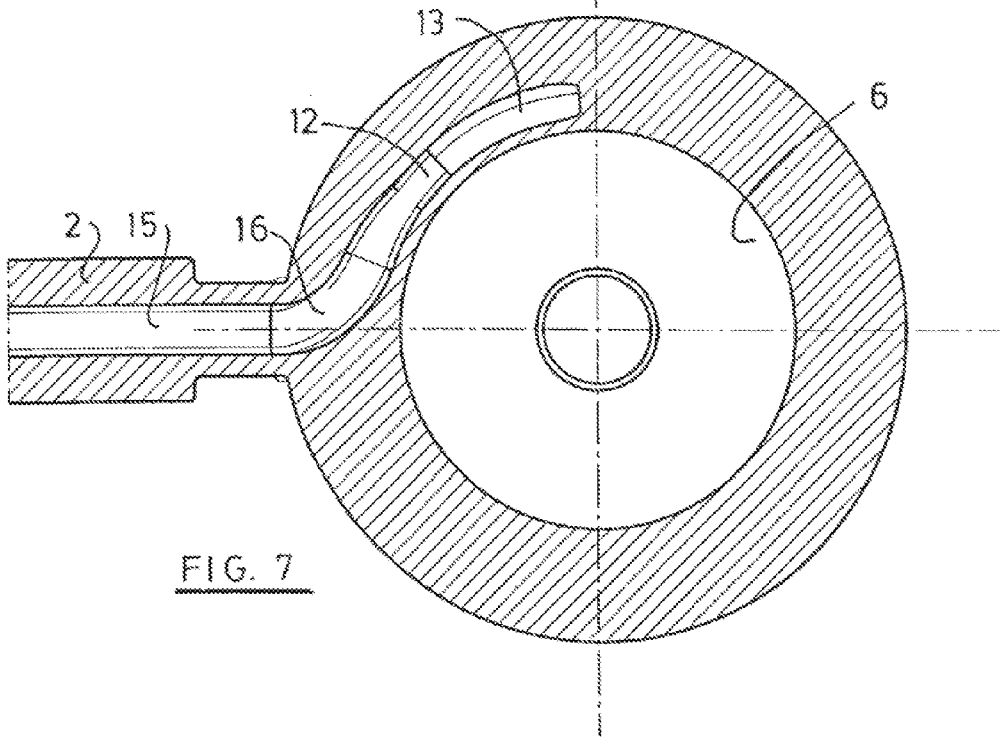
FIG. 7 shows a cross section through the shower head of FIG. 6.

The longitudinal section in FIG. 6 corresponds to the longitudinal section in FIG. 3, but shows an embodiment of a shower head which has been modified in relation to the previous embodiment. It is evident from the longitudinal section in FIG. 6 that there is no longer any channel visible to the right of the chamber 6. The explanation for this can be gathered from FIG. 7. Here, although the channel 12 also extends along a circumference around the chamber 6, it does so only over an arc length measuring a quarter of a circle, including the extent of the outlet opening 13. It is also evident from the drawing here that the cross section of the channel 12 decreases downstream of the arcuate conduit portion 16.

Figure 8:
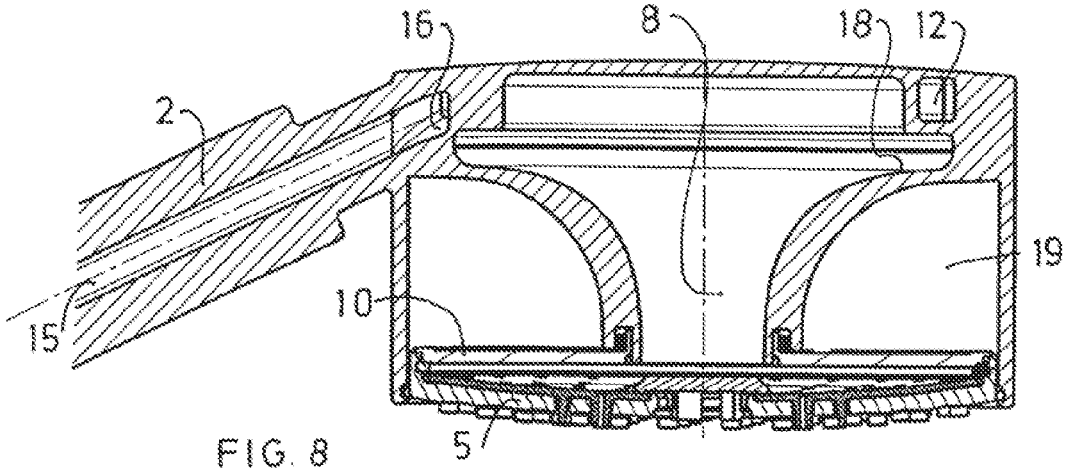
FIG. 8 shows a further longitudinal section through a shower head.
Figure 9:
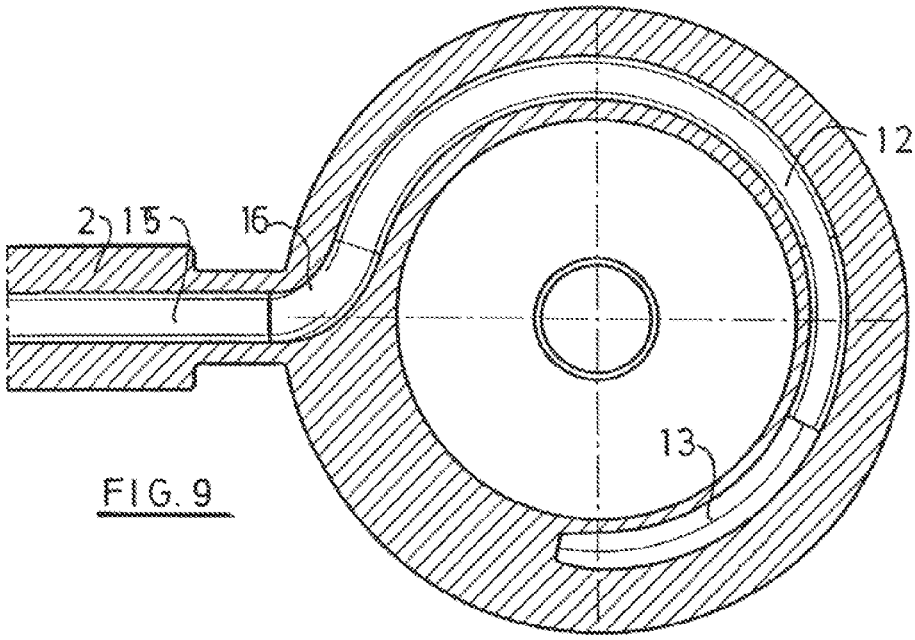
FIG. 9 shows a cross section through the shower head of FIG. 8.

The longitudinal section through the shower head in FIG. 8 is intended to show that such a massage action with a shower attachment can be achieved even when the axial extent of the tapering region, rather than being as short as in the case of the previous embodiments, assumes a length as is shown in FIG. 8. In FIG. 8, the length of the tapering region 8 is approximately half the size of the largest diameter of the chamber 6. In the case of the previous embodiments, the axial extent of the tapering region is considerably smaller.

Figure 4:
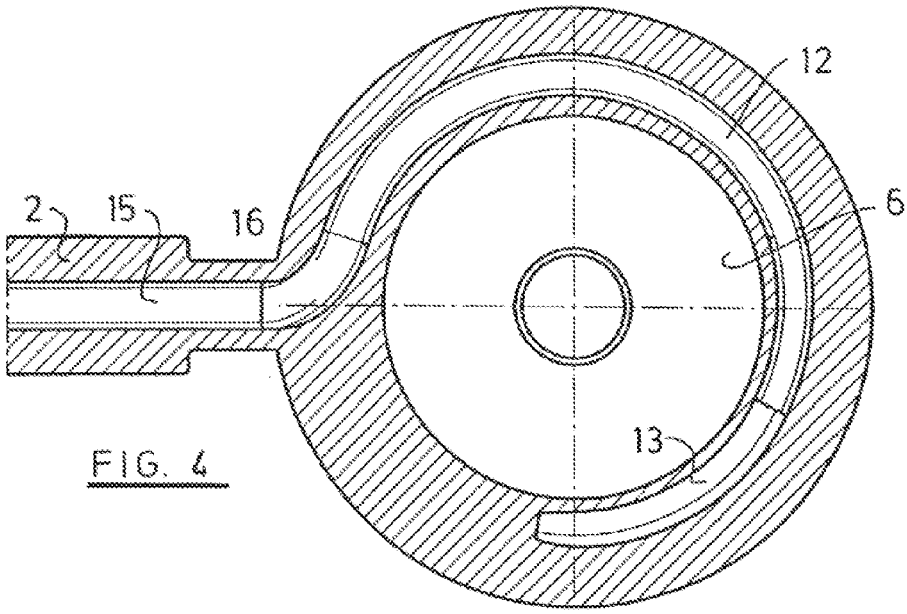
FIG. 4 shows an angled cross section through the hand-held shower attachment of FIG. 3.
Figure 10:
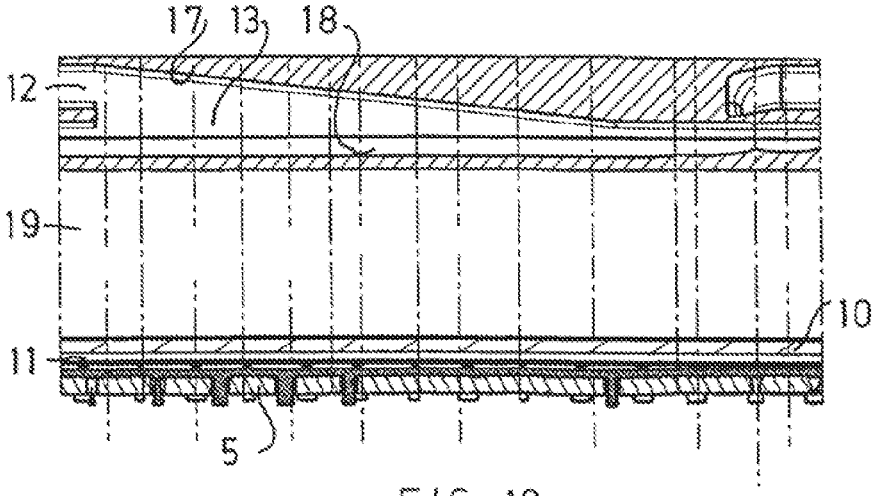
FIG. 10 shows a curved section through the shower head of FIGS. 8 and 9.

In the case of this embodiment, the channel and its outlet opening 13 progress in the same way as in the embodiment according to FIG. 4. It can also be seen here, see FIG. 10, that the beginning 18 of the wall of the tapering region 8 is located opposite the outlet opening 13, and therefore, here too, the water flow is directed gradually into the vortex funnel of the tapering region 8.

Figure 11:
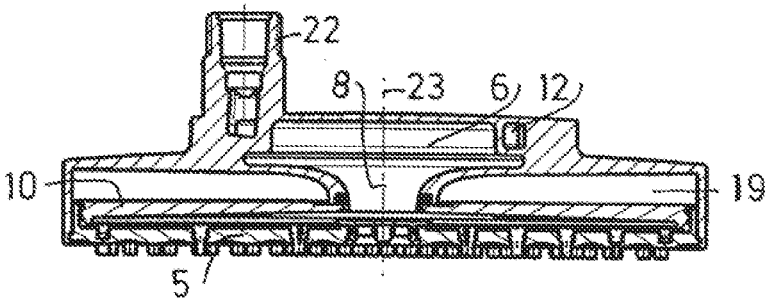
FIG. 11 shows a section through a shower head.
Figure 12:
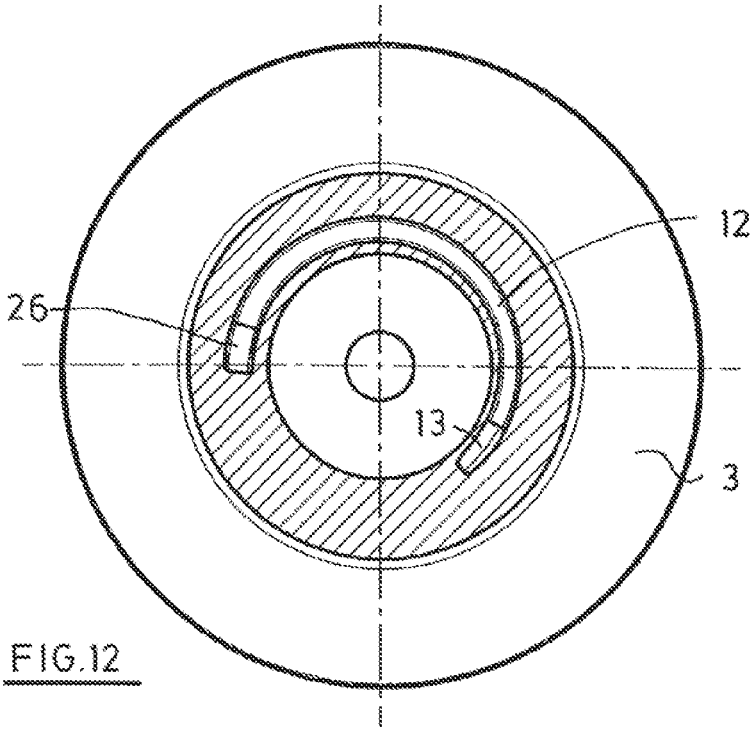
FIG. 12 shows a cross section through the shower head of FIG. 11.
Figure 13:
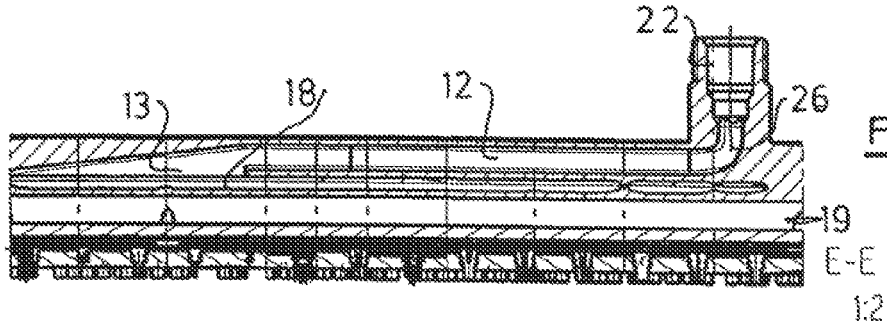
FIG. 13 shows a curved section through the shower head.

While the previous embodiments show shower heads of hand-held shower attachments, in which the water enters radially through the handgrip 2, FIGS. 11 to 13 show an embodiment in which the shower head constitutes an overhead shower attachment, that is to say one which does not contain any handgrip. The water here enters through a connection stub 22, which runs in the axial direction. It is offset laterally in relation to the indicated axis 23 of the shower head. This connection stub 22 has formed at its end an arcuate conduit portion 26, out of which the water is directed through 90° into the channel 12, which then leads in the same manner again around the chamber 6 formed in the shower head. The channel 12 here extends over approximately 180°, that is to say a semicircle. The end of the channel 12, once again, has an outlet opening 13, which is directed towards the beginning 18 of the wall of the tapering region 8.

The shower head of FIGS. 11 to 13 is an example to show that the diameter of the jet-outlet chamber 11, which is formed between the spray disc 5 and the base 10, can be even significantly greater than the maximum diameter of the chamber 6, into which the water enters in order to generate a vortex flow. Even in the case of such a large difference between the diameter of the constriction at the end of the tapering region 8 and the diameter of the jet-outlet chamber 11, the vortexing of the water still leads to a massage action even in the outer region of the jet-outlet disc 5.

Figure 14:
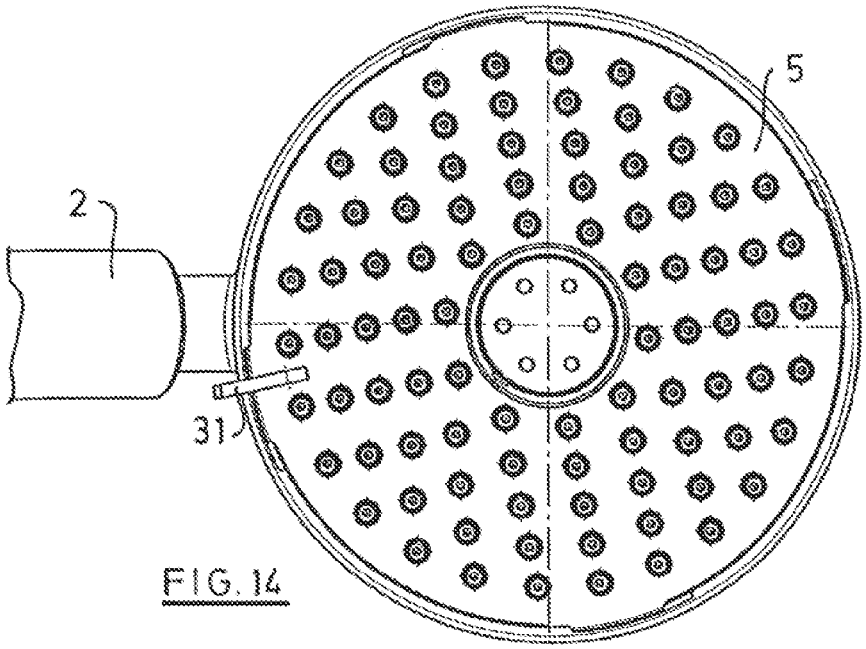
FIG. 14 shows a view of a hand-held shower attachment with the spray disc.
Figure 16:
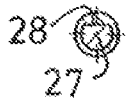
FIG. 16 shows a partial section through a guide element.
Figure 15:
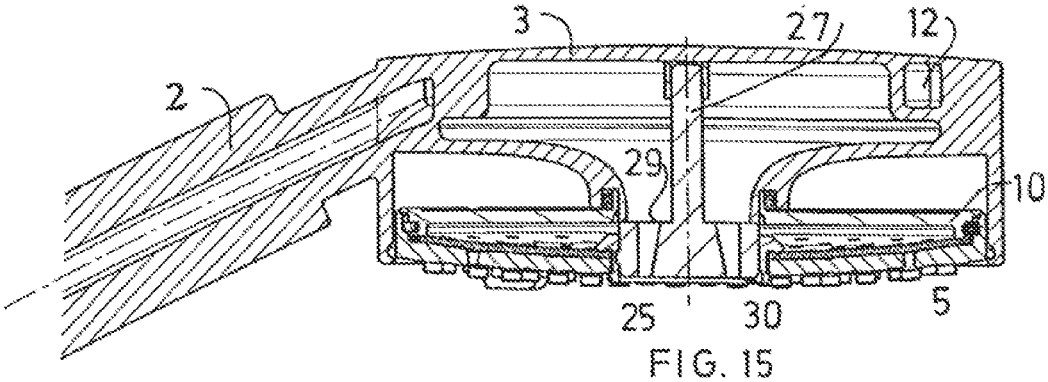
FIG. 15 shows a longitudinal section through the hand-held shower attachment of FIG. 14.

It has already been mentioned that the jet-outlet disc may also have a plurality of regions which can be activated separately. In this respect, reference is made to FIG. 14, which shows a view of the hand-held shower attachment as seen by the user. The spray disc 5 can thus be seen here. The spray disc, together with the base 10 of the jet-outlet chamber 11, is mounted in a rotatable manner on the outside of the end of the tapering region 8. The centre of the spray disc 5 contains an aperture in which a spray-disc core 25 is arranged. The periphery of the aperture of the spray disc 5 engages in a circumferential groove on the outside of the spray-disc core 25. This circumferential groove runs obliquely and forms a curve which interacts with the periphery of the aperture. The spray-disc core 25 has a stem 27 guided in a bushing 28 on the inside of the rear wall 3. As can be seen from the illustration in FIG. 16, the stem 27 is designed such that it cannot be rotated in relation to the bushing 28. Upon rotation of the spray disc 5, the spray-disc core 25 is thus displaced slightly in the direction of its stem 27 in accordance with the slope of the curve in the circumferential groove. FIG. 15 shows the position where the inwardly directed shoulder 29 of the spray-disc core 25 butts against the periphery of the outlet opening of the tapering region 8. The spray-disc core has six jet-outlet openings 30 passing right through it. In the position of FIG. 15, the water passes out of the chamber 6 exclusively through the jet-outlet opening 30 of the spray-disc core 25. The relatively large jet-outlet openings 30 give rise to a hard massage jet here on account of the water vortex in the chamber 6.

The through-passage openings 30 together preferably have a similar throughflow cross section to the jet-out let openings in the outer region taken together.

Figure 17:
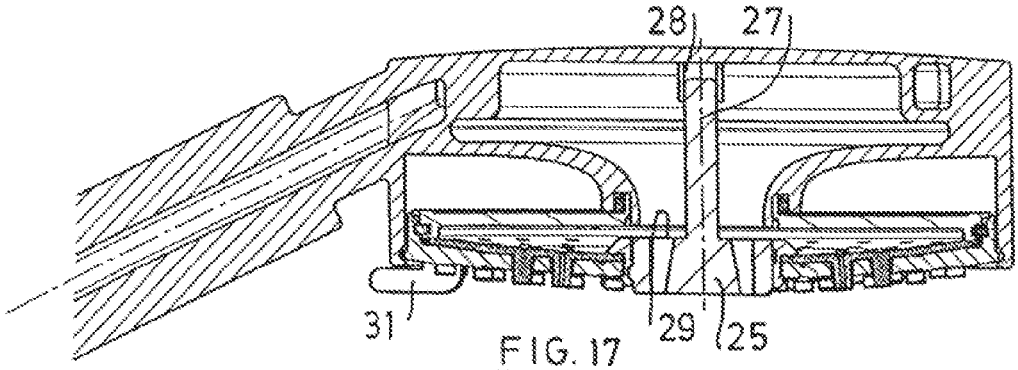
FIG. 17 shows a longitudinal section through the hand-held shower attachment of FIG. 14, this time in a different position.

If the spray disc 5 is rotated with the aid of the adjusting extension 31, then the spray-disc core 25 is displaced into the position which is illustrated in FIG. 17. The shoulder 29 of the spray-disc core 25 lifts up from the periphery of the opening at the end of the tapering region 8. The water now flows past the shoulder 29 into the outer region of the jet-outlet chamber. The high speed of the water in the circumferential direction causes the rotating vortex to jump immediately outwards, and therefore it is not possible for any water to exit from the jet-outlet openings 30 of the spray-disc core 25, despite the relatively large cross section of these openings. There is not therefore any need for sealing.

The spray-disc core, which is displaced in the case of the embodiment illustrated, may also have a different number of jet-outlet openings 30. It is likewise conceivable for it to contain a single central opening.

In the case of the embodiment illustrated, the spray-disc core can be moved axially, whereas the spray disc outside the core is fixed. It is also conceivable for the spray disc to be displaced as a whole in order for the various regions of the spray disc to be switched on.

The invention claimed is:

1. A shower head, comprising:

a shower-head housing which is bounded on one side by a spray disc and has a water inlet, a chamber being formed in the housing, which chamber tapers inwardly from an inlet region toward the spray disc such that walls of the chamber form a funnel-like tapering region, further comprising a water guide which leads into the chamber from the water inlet, wherein the water guide has a channel that directs water to run circumferentially around the funnel-like tapering region into the inlet region of the chamber.

2. The shower head according to claim 1, wherein, as seen in a cross section running parallel to the spray disc, the chamber has a rounded circumference.

3. The shower head according to claim 1, wherein, as seen in an axial direction of the shower head, the water guide opens out tangentially into the inlet region of the chamber.

4. The shower head according to claim 1, wherein the tapering region of the chamber begins at least more or less parallel to a cross-sectional plane.

5. The shower head according to claim 1, wherein the tapering region of the chamber terminates in a constriction in which a wall of the tapering region runs perpendicularly to the spray disc.

6. The shower head according to claim 1, wherein a ratio between a diameter of the chamber in the inlet region and a diameter of the chamber at an end of the tapering region that leads to the spray disc is in a region of approximately 6:1 to 4:1.

7. The shower head according to claim 1, wherein the water inlet into the housing runs approximately radially in relation to the housing.

8. The shower head according to claim 1, wherein the water inlet into the housing runs approximately axially in relation to the housing.

9. A shower head, comprising: a shower-head housing which is bounded on one side by a spray disc and has a water inlet, a chamber being formed in the housing, which chamber tapers from an inlet region in the direction of the spray disc, further comprising a water guide which leads into the chamber from the water inlet and which opens out tangentially, in the circumferential direction, into the inlet region of the chamber, and wherein the water guide from the water inlet into the housing is designed as a channel which runs at least partially along a circumference around the chamber and opens out in an opening in the inlet region of the chamber.

10. The shower head according to claim 9, wherein the channel runs along the circumference over an angle of at least 20°.

11. The shower head according to claim 1, wherein the outlet opening of the channel extends over an angle of approximately 20°.

12. The shower head according to claim 9, wherein the outlet opening of the channel of the water guide is located in a cross-sectional plane parallel to the spray disc.

13. The shower head according to claim 9, wherein a wall of a tapering region of the chamber, said wall running more or less parallel to a cross-sectional plane, is located opposite the outlet opening of the channel.

14. The shower head according to claim 9, wherein the channel has a cross section which decreases in a flow direction.

15. A shower head, comprising: a shower-head housing which is bounded on one side by a spray disc and has a water inlet, a chamber being formed in the housing, which chamber tapers from an inlet region in the direction of the spray disc, further comprising a water guide which leads into the chamber from the water inlet and which opens out tangentially, in the circumferential direction, into the inlet region of the chamber, wherein the diameter of the jet-outlet chamber is greater than the diameter of the opening of the tapering region of the chamber, and wherein, at its end leading to the spray disc, the tapering region terminates in an opening which is adjoined by a jet-outlet chamber bounded by the spray disc.

16. The shower head according to claim 15, wherein the diameter of the jet-outlet chamber corresponds more or less to a diameter of the chamber formed in the shower head in a region of the inlet region.

17. The shower head according to claim 15, wherein the diameter of the jet-outlet chamber is greater than a largest diameter of the chamber formed in the shower head.

18. The shower head according to claim 15, wherein on its side directed away from the spray disc, the jet-outlet chamber is bounded by a base.

19. The shower head according to claim 1, wherein a distance between the spray disc and an end of the tapering region that leads to the spray disc is smaller than a diameter of said end of the tapering region.

20. The shower head according to claim 1, wherein, on a side of the inlet region which is directed away from the spray disc, the chamber formed in the shower head continues as far as a rear wall of the shower-head housing.

21. The shower head according to claim 15, wherein the jet-outlet chamber is designed as a flat disc-like chamber.

22. The shower head according to claim 1, wherein the spray disc has a plurality of regions, and a switchover device switches over between these regions.

23. The shower head according to claim 22, wherein jet-outlet openings of the plurality of regions are of different sizes.

24. The shower head according to claim 22, wherein the switchover device has a mechanical interruption just in one position.

* * * * *